US009482042B2

(12) United States Patent
Boyes

(10) Patent No.: US 9,482,042 B2
(45) Date of Patent: Nov. 1, 2016

(54) SECURE ENCLOSURE

(75) Inventor: James A. Boyes, Blairgowrie (GB)

(73) Assignee: NCR Corporation, Duluth, GA (US)

( * ) Notice: Subject to any disclaimer, the term of this patent is extended or adjusted under 35 U.S.C. 154(b) by 1461 days.

(21) Appl. No.: 12/621,770

(22) Filed: Nov. 19, 2009

(65) Prior Publication Data

US 2011/0113991 A1 May 19, 2011

(51) Int. Cl.
*E05G 1/026* (2006.01)
*E05G 1/024* (2006.01)

(52) U.S. Cl.
CPC ..... *E05G 1/024* (2013.01); *E05G 1/026* (2013.01)

(58) Field of Classification Search
USPC ..... 109/58, 59 R, 64, 66, 74, 76, 77
See application file for complete search history.

(56) References Cited

U.S. PATENT DOCUMENTS 1,749,222 A * 3/1930 Merriam ..... 109/74
1,781,488 A * 11/1930 Abbott ..... 109/74
2,030,219 A * 2/1936 Meilink ..... 70/271
2,823,536 A * 2/1958 Watson ..... 70/1.5
3,408,966 A * 11/1968 Gartner ..... 109/74
3,709,169 A * 1/1973 Gauger et al. ..... 109/29
3,735,714 A * 5/1973 Shoop ..... 109/59 R
3,855,949 A * 12/1974 Foster et al. ..... 109/23
4,593,627 A * 6/1986 Lankard et al. ..... 109/83
4,704,970 A * 11/1987 Sanderson et al. ..... 109/73
6,752,092 B2 * 6/2004 Beattie et al. ..... 109/75
7,387,076 B2 * 6/2008 Bauman et al. ..... 109/59 R

* cited by examiner

*Primary Examiner* — Christopher Boswell
(74) *Attorney, Agent, or Firm* — Schwegman, Lundberg & Woessner

(57) ABSTRACT

A secure enclosure comprises: a pair of opposing sidewalls; an upper wall coupled to the pair of opposing sidewalls; a lower wall opposite the upper wall and also coupled to the pair of opposing sidewalls; and an end wall coupled to the upper and lower walls and the opposing sidewalls, so that the pair of opposing sidewalls, the upper wall, the lower wall, and the end wall together form a body defining an opening. The secure enclosure also comprises a door leaf hingeably coupled to one of the opposing sidewalls for securely closing the opening. The door leaf is arranged to engage with the pair of opposing sidewalls and includes an overlapping portion so that when the door leaf is in the closed position, the overlapping portion extends towards the end wall and covers a portion of a sidewall abutting the door leaf.

14 Claims, 2 Drawing Sheets

FIG. 3
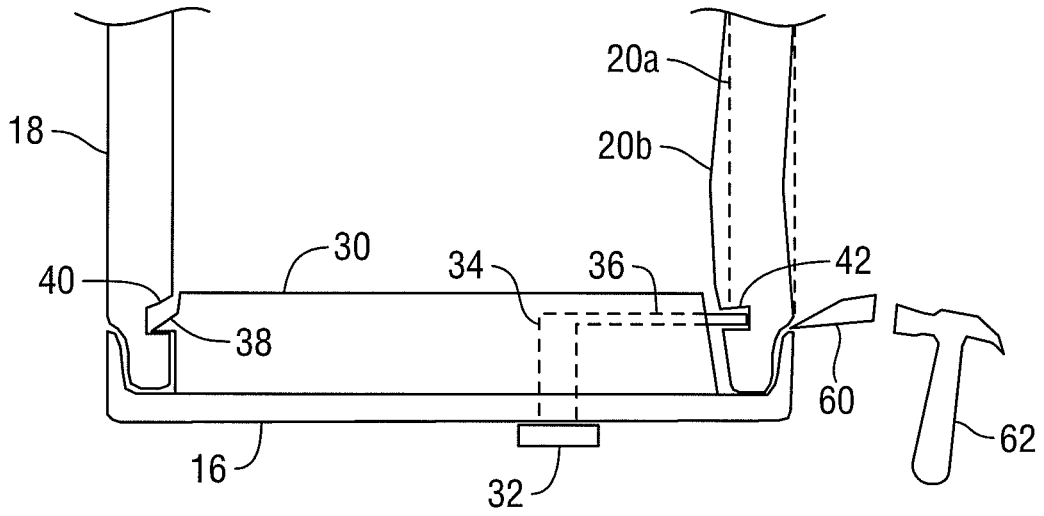
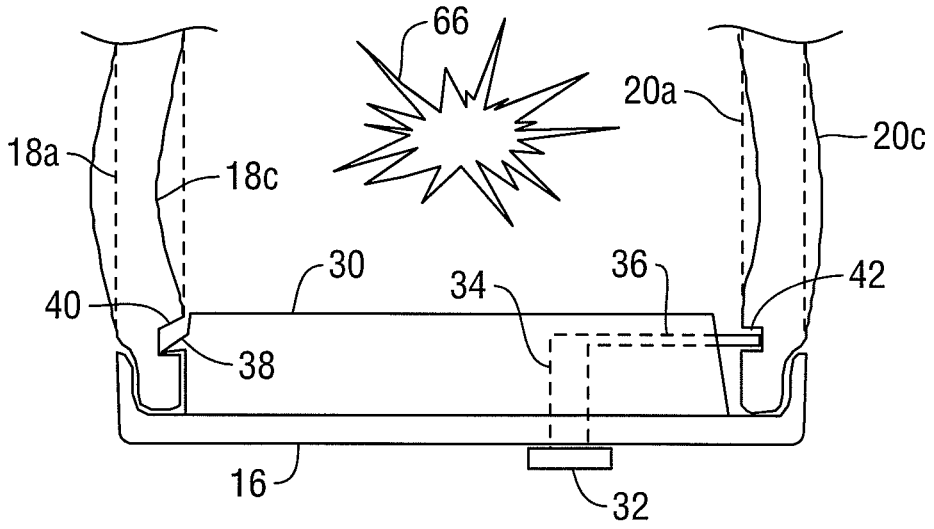
FIG. 4

SECURE ENCLOSURE

FIELD OF INVENTION

The present invention relates to improvements in or relating to a secure enclosure.

BACKGROUND OF INVENTION

Secure enclosures, such as safes, strongrooms, and vaults, are typically used to store valuable items. One particular application of secure enclosures is to house valuable components of an automated teller machine (ATM), such as a cash dispenser, a cash acceptance module, and the like. The value of such components is principally derived from the large amounts of cash stored within them.

Secure enclosures provided in ATMs (hereinafter "ATM safes") differ from conventional safes in that ATM safes include apertures. These apertures may be in the form of (i) slots through which media items (such as banknotes) enter and exit a cash dispenser/recycler in the ATM safe, and (ii) holes through which control cables pass from the cash dispenser/recycler to an ATM controller.

ATM safes are designed to resist attack from many different types of tools, such as sledgehammers, power drills, and thermal cutting tools. One common attack involves driving a wedge between a door and a sidewall of an ATM safe to release the safe door.

It is also becoming increasingly common for ATM safes to be subjected to attacks from explosives, such as plastic explosives, or explosive gas (for example, oxyacetylene or butane gas). In a typical attack, an ATM aperture is created or accessed, for example by drilling or cutting through a thin shutter covering an existing aperture, such as a cash dispense slot. The explosive substance (solid or gas) is inserted into the ATM through this aperture then detonated. This causes the safe sidewalls to deflect outwards, thereby releasing the door, which is blown off its hinges by the explosion.

ATM safes can be designed to withstand explosive attacks by strengthening the ATM safe door and the internal corners of the ATM safe. However, explosion-resistant ATM safes typically cost several times the price of a similar safe which does not resist an explosive attack.

It would be advantageous to be able to provide a low-cost safe that is resistant to both conventional wedge attacks and attacks using explosives.

SUMMARY OF INVENTION

Accordingly, the invention generally provides methods, systems, and apparatus for an improved secure enclosure having a door partially surrounding one or more sidewalls of the secure enclosure.

In addition to the Summary of Invention provided above and the subject matter disclosed below in the Detailed Description, the following paragraphs of this section are intended to provide further basis for alternative claim language for possible use during prosecution of this application, if required. If this application is granted, some aspects of the invention may relate to claims added during prosecution of this application, other aspects may relate to claims deleted during prosecution, other aspects may relate to subject matter never claimed. Furthermore, the various aspects detailed hereinafter are independent of each other, except where stated otherwise. Any claim corresponding to one aspect should not be construed as incorporating any element or feature of the other aspects unless explicitly stated in that claim.

According to a first aspect of the present invention there is provided a secure enclosure comprising:

a pair of opposing sidewalls;

an upper wall coupled to the pair of opposing sidewalls;

a lower wall opposite the upper wall and also coupled to the pair of opposing sidewalls;

an end wall coupled to the upper and lower walls and the opposing sidewalls, so that the pair of opposing sidewalls, the upper wall, the lower wall, and the end wall together form a body defining an opening; and a door leaf hingeably coupled to one of the opposing sidewalls for securely closing the opening, the door leaf being arranged to engage with the pair of opposing sidewalls and including an overlapping portion so that when the door leaf is in a closed position, the overlapping portion extends towards the end wall and covers a portion of a sidewall abutting the door leaf.

Advantageously, the overlapping portion extends towards the end wall outside (rather than inside) the sidewall.

It is preferable, but not essential, for the overlapping portion to extend the full height of a sidewall to inhibit a wedge attack anywhere on that sidewall.

It is also preferable, but not essential, for the door leaf to include two overlapping portions, defined on opposing sides of the door leaf, for engaging with both opposing sidewalls when the door leaf is in the closed position.

The door leaf may include four overlapping portions, each overlapping portion defined on a different side of the door leaf. This enables the overlapping portions to cover parts of: each of the two opposing sidewalls, the upper wall, and the lower wall.

One or both of the opposing sidewalls may include a reduced width portion at an end opposite the end wall. The reduced width portion may be arcuate or stepped.

The overlapping portion and its corresponding sidewall portion may define mutually complementary formations. For example, a sidewall may include a tapered portion proximal the door leaf, and the door leaf may include a profiled portion (as part or all of the overlapping portion) for mating with the tapered portion. Any convenient complementary formations may be provided.

The opposing sidewalls may have a composite construction, or may comprise a single material, such as steel.

The composite construction may comprise a central material sandwiched between two layers (an external layer on an outer surface of the central material and an internal layer on an inner surface of the central material). The central material may comprise steel, high density concrete, or the like. In one embodiment, the central material comprises high density concrete incorporating a first set of parallel, spaced, rods aligned in a first direction, and a second set of parallel, spaced, rods aligned transverse to the first direction. Other conventional components may be included to improve resistance of the walls to attack, for example, fragments of metal may be incorporated into the central material.

The external layer and the internal layer may be thin relative to the thickness of the central material.

By virtue of this aspect of the invention, a secure enclosure is provided that is more resistant to wedge attacks because the gap between a sidewall and the door leaf is part of the way along the sidewall side, not on the door leaf side, so any wedge introduced into the gap will drive the sidewall inwards causing bolts on an inner side of the door leaf to engage further with a recess defined by the inner side of the sidewall being attacked.

Furthermore, in the event of a gas attack, the overlapping portion or portions (if used on both upright sides of the door leaf) will restrict the opposing sidewalls from deflecting outwards, thereby supporting the door leaf.

According to a second aspect of the present invention there is provided a secure enclosure comprising: a body defining an opening, the body including a pair of opposing sidewalls, an upper wall opposite a lower wall, and an end wall coupled to the upper and lower walls and the opposing sidewalls; and a door leaf hingeably coupled to the body for securely closing the opening, the door leaf being arranged to engage with the pair of opposing sidewalls and to protrude beyond at least one of the sidewalls in the direction of the end wall.

According to a third aspect of the present invention there is provided a secure enclosure comprising: a body defining an opening, the body including a pair of opposing sidewalls, an upper wall opposite a lower wall, and an end wall coupled to the upper and lower walls and the opposing sidewalls; and a door leaf hingeably coupled to the body for securely closing the opening, the door leaf being dimensioned to extend beyond the pair of opposing sidewalls so that there is no gap at the front of the secure enclosure between a sidewall and the door leaf.

According to a fourth aspect of the present invention there is provided a self-service terminal including the secure enclosure of the first, second, or third aspects of the invention.

The self-service terminal may comprise an automated teller machine (ATM), an information kiosk, a financial services center, a bill payment kiosk, a lottery kiosk, a postal services machine, a check-in and/or check-out terminal such as those used in the retail, hotel, car rental, gaming, healthcare, and airline industries, or the like.

The self-service terminal may further comprise a user interface. The user interface may comprise a display, an input mechanism (such as a keypad, a mouse, a touch-sensitive panel, or the like), and a media dispenser.

For clarity and simplicity of description, not all combinations of elements provided in the aspects of the invention recited above have been set forth expressly. Notwithstanding this, the skilled person will directly and unambiguously recognize that unless it is not technically possible, or it is explicitly stated to the contrary, the consistory clauses referring to one aspect of the invention are intended to apply mutatis mutandis as optional features of every other aspect of the invention to which those consistory clauses could possibly relate.

These and other aspects will be apparent from the following specific description, given by way of example, with reference to the accompanying drawings.

BRIEF DESCRIPTION OF THE DRAWINGS

FIG. 3 is a simplified schematic plan view of the door leaf and parts of the sidewalls of the secure enclosure of FIG. 1 during a wedge attack; and FIG. 4 is a simplified schematic plan view of the door leaf and parts of the sidewalls of the secure enclosure of FIG. 1 during a gas explosion attack.

DETAILED DESCRIPTION

Figure 1:
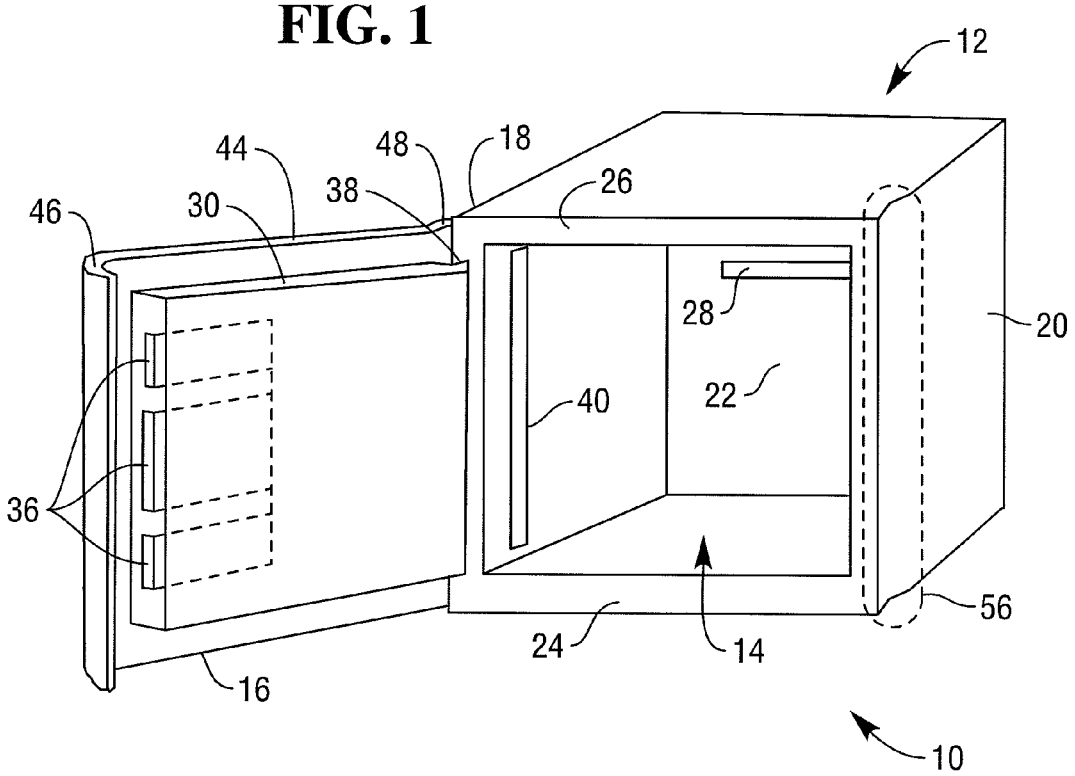
FIG. 1 is a simplified schematic perspective view of a secure enclosure according to one embodiment of the present invention.

Reference is first made to FIG. 1, which is a schematic perspective view of a secure enclosure 10, in the form of an ATM safe, according to one embodiment of the present invention. The ATM safe 10 is designed for use in a rear access ATM and comprises a body 12 defining an opening 14 at the rear of the body 12, and a door leaf 16 hingeably coupled to the front of the body 12 for securely closing the opening 14.

The body 12 comprises two opposing sidewalls 18,20, and an end wall 22, all upstanding from a lower wall (the base) 24 to an upper wall (the roof) 26, so that the body 12 defines the opening (cavity) 14 in which an ATM cash dispenser (not shown) can be located. The end wall 22 defines an aperture 28, in the form of a dispensing slot, through which the ATM cash dispenser can dispense banknotes.

Figure 2:
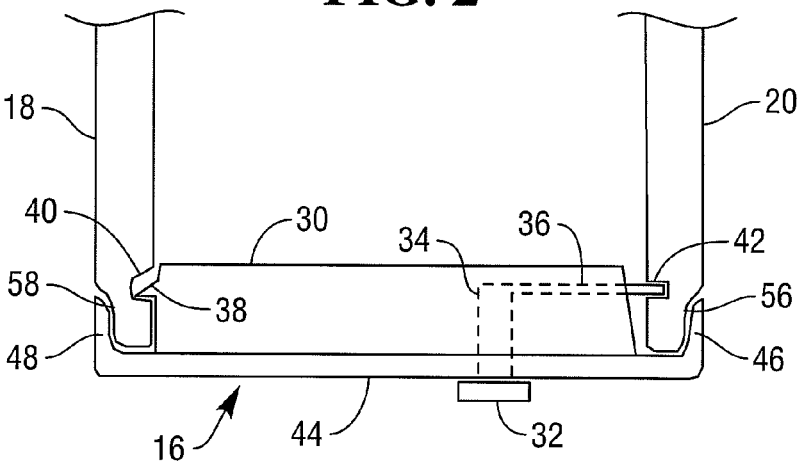
FIG. 2 is a simplified schematic plan view of a portion (the door leaf and parts of the sidewalls) of the secure enclosure of FIG. 1.

Reference will now also be made to FIG. 2, which is a schematic plan view of the door leaf 16 and portions of the sidewalls 18,20.

The door leaf 16 includes a boltwork casing 30 that encloses a handle 32, a lock mechanism 34, and engagement bars 36, and that defines an upright protrusion 38. The handle 32, lock 34, engagement bars 36, and protrusion 38 are of the type conventionally used on ATM safes.

When the door leaf 16 is in the closed position, the upright protrusion 38 engages with a complementary recess 40 in the left hand sidewall 18. The handle 32 can then be rotated so that the engagement bars 36 protrude into a recess 42 in the right hand sidewall 20.

The door leaf 16 further comprises a central planar portion 44 separating two overlapping portions 46,48 defining opposing vertical edges of the door leaf 16. The overlapping portions 46,48 are curved and complement corresponding curved portions 56,58 on the sidewalls 20,18. Thus, when the door leaf 16 is closed, the overlapping portion 46 of the door leaf 16 abuts the curved portion 56 of the sidewall 20 to provide a tight fit. Similarly, when the door leaf 16 is closed, the overlapping portion 48 of the door leaf 16 abuts the curved portion 58 of the sidewall 18 to provide a tight fit. Thus, the overlapping portions 46,48 cover a side portion (not merely an end portion) of the respective sidewalls 20,18.

Reference will now also be made to FIG. 3, which is a plan view similar to that of FIG. 2, but illustrating a wedge attack against the right sidewall 20.

As shown in FIG. 3, a wedge attack involves a criminal using a wedge 60 and hammer 62 to try and pry open the door leaf 16. In this embodiment, when the door leaf 16 is closed and the engagement bars 36 are protruding into the recess 42, any wedge attack in the gap between the door leaf 16 and the sidewall 20 forces the sidewall 20 inwards to position 20*b* (shown exaggerated in FIG. 3 for illustration purposes) from original position 20*a* (shown in broken line in FIG. 3), causing the engagement bars 36 to protrude even further into the recess 42. This ensures that the door leaf 16 is held even more securely in place.

Reference will now also be made to FIG. 4, which is a plan view similar to that of FIG. 2, but illustrating a gas explosion attack against the secure enclosure 10.

As shown in FIG. 4, a gas explosion attack involves a criminal injecting gas into the body 12, for example, via dispensing slot 28. When the gas is ignited (illustrated graphically and referenced by numeral 66) there is an immediate pressure build up that forces all of the walls of the secure enclosure 10 outwards, as illustrated in FIG. 4 by the right sidewall 20 deflecting from its normal shape 20*a* to a convex shape 20*c* (shown exaggerated in FIG. 4 for illustration purposes), and the left sidewall 18 deflecting from its normal shape 18*a* to a convex shape 18*c*. However, the overlapping portions 46,48 hold the sidewalls 18,20 in place to prevent the sidewalls 18,20 from bowing too much. This ensures that (i) the engagement bars 36 remain within the recess 42, and (ii) the upright protrusion 38 remains within the complementary recess 40. This reduces the risk of the door leaf 16 being blown off its hinges.

It will now be apparent that the above embodiment has the advantage of reducing the likelihood of success of a wedge attack and also reducing the likelihood of success of a gas explosion attack, without significantly increasing the cost of the secure enclosure.

Various modifications may be made to the above described embodiment within the scope of the invention, for example, in other embodiments, overlapping portions may also be provided on horizontal edges of the door leaf so that the door leaf partially surrounds the sidewalls, the upper wall, and the lower wall.

In other embodiments, different shapes of overlapping portions may be provided.

In other embodiments, the secure enclosure may be used in self-service terminals other than an ATM, or in applications other than self-service terminals, such as strongrooms or vaults.

In other embodiments, a single overlapping portion may be provided on the opposite side of the door leaf to the hinge.

The terms "comprising", "including", "incorporating", and "having" are used herein to recite an open-ended list of one or more elements or steps, not a closed list. When such terms are used, those elements or steps recited in the list are not exclusive of other elements or steps that may be added to the list.

Unless otherwise indicated by the context, the terms "a" and "an" are used herein to denote at least one of the elements, integers, steps, features, operations, or components mentioned thereafter, but do not exclude additional elements, integers, steps, features, operations, or components.

What is claimed is:

1. A secure enclosure comprising:

a pair of opposing sidewalls;

an upper wall coupled to the pair of opposing sidewalls;

lower wall opposite the upper wall and also coupled to the pair of opposing sidewalls;

an end wall coupled to the upper and lower walls and the opposing sidewalls, so that the pair of opposing sidewalls, the upper wall, the lower wall, and the end wall together form a body defining an opening; and a door leaf hingeably coupled to one of the opposing sidewalls for securely closing the opening, the door leaf being arranged to engage with the pair of opposing sidewalls and including an overlapping portion so that when the door leaf is in the closed position, the overlapping portion extends towards the end wall and covers an outer portion of a sidewall abutting the door leaf.

2. A secure enclosure according to claim 1, wherein the overlapping portion extends the full height of a sidewall to inhibit a wedge attack anywhere on that sidewall.

3. A secure enclosure according to claim 1, wherein the door leaf includes two overlapping portions, defined on opposing sides of the door leaf, for engaging with both opposing sidewalls.

4. A secure enclosure according to claim 1, wherein the door leaf includes four overlapping portions, one overlapping portion for each of the two opposing sidewalls, the upper wall, and the lower wall.

5. A secure enclosure according to claim 1, wherein at least one of the opposing sidewalls includes a reduced width portion at an end opposite the end wall.

6. A secure enclosure according to claim 1, wherein the overlapping portion and its corresponding sidewall define mutually complementary formations.

7. A secure enclosure according to claim 1, wherein the opposing sidewalls have a composite construction.

8. A secure enclosure according to claim 1, wherein the secure enclosure includes a currency dispenser.

9. A self-service terminal comprising a secure enclosure according to claim 1.

10. The secure enclosure of claim 1 wherein the opposing sidewalls have curved outer portions and the door leaf has overlapping portions which are curved and which abut the curved outer portions of the opposing sidewalls when the door leaf is in the closed position.

11. The secure enclosure of claim 10 wherein the overlapping portions hold the opposing sidewalls in place to reduce the risk of the door leaf being blown off the hinges.

12. The secure enclosure of claim 1 wherein one of the opposing sidewalls comprises a recess for receiving an engagement bar protruding into the recess when the secure the engagement bar to be held more securely in the recess ensuring the door leaf is held securely in place.

13. The secure enclosure of claim 12 further comprising a handle which is rotated to cause the engagement bar to protrude into the recess.

14. The secure enclosure of claim 12 further comprising plural engagement bars.

* * * * *